US005645399A

United States Patent [19]

Angus

[11] Patent Number: 5,645,399

[45] Date of Patent: Jul. 8, 1997

[54] GAS TURBINE ENGINE CASE COATED WITH THERMAL BARRIER COATING TO CONTROL AXIAL AIRFOIL CLEARANCE

[75] Inventor: Todd James Angus, Simsbury, Conn.

[73] Assignee: United Technologies Corporation, Hartford, Conn.

[21] Appl. No.: 404,230

[22] Filed: Mar. 15, 1995

[51] Int. Cl.[6] ..... F01D 25/14

[52] U.S. Cl. ..... 415/178; 415/177

[58] Field of Search ..... 415/177, 178

[56] References Cited

U.S. PATENT DOCUMENTS 4,642,027 2/1987 Popp ..... 415/177

4,659,282 4/1987 Popp ..... 415/177

5,127,795 7/1992 Plemmons et al. ..... 415/177

*Primary Examiner*—Edward K. Look

*Assistant Examiner*—Christopher Verdier

*Attorney, Agent, or Firm*—Marina F. Cunningham

[57] ABSTRACT

An engine case of a gas turbine engine is selectively coated with a thermal barrier coating to control axial clearance between rotating and stationary airfoils. The coating is applied to the thinner portions of the engine case to retard thermal expansion of these portions of the engine case during transient conditions of the gas turbine engine operation. The selectively coated engine case responds substantially uniformly to heating and thermal expansion during transient conditions, thereby reducing axial vane lean in gas turbine engines.

1 Claim, 2 Drawing Sheets

GAS TURBINE ENGINE CASE COATED WITH THERMAL BARRIER COATING TO CONTROL AXIAL AIRFOIL CLEARANCE

TECHNICAL FIELD

The present invention relates to gas turbine engines and, more particularly, to the axial clearance between airfoils therefor.

BACKGROUND OF THE INVENTION

Typical gas turbine engines include a compressor, a combustor, and a turbine. The sections of the gas turbine engine are sequentially situated about a longitudinal axis and are enclosed in an engine case. Air flows axially through the engine. As is well known in the art, air compressed in the compressor is mixed with fuel, ignited and burned in the combustor. The hot products of combustion emerging from the combustor are expanded in the turbine, thereby rotating the turbine and driving the compressor.

Both the compressor and the turbine include alternating rows of stationary vanes and rotating blades. The blades are secured within a rotating disk. The vanes are typically cantilevered from the engine case. The radially outer end of each vane is mounted onto the engine case at a forward attachment point and a rear attachment point.

It is critical that the vanes and blades do not come into contact with each other during engine operation. Even if one vane obstructs the rotating path of a blade during engine operation, the entire row of blades will become dented, bent, or damaged as a result of the high rotational speeds of the blades. Even relatively small damage on the blade will propagate as a result of the centrifugal forces to which the rotating blades are subjected. Ultimately, this will result in the loss of a blade or a part thereof. Furthermore, damage disposed on the radially inward portion of the blade is more undesirable since the greater centrifugal force increases the likelihood of failure.

Axial clearance between the rows of vanes and blades is provided to prevent interference between the stationary vanes and the rotating vanes. For optimal gas turbine engine performance, it is desirable to minimize axial clearance between the blades and vanes. However, axial clearance must be sufficient to avoid the risk of potential interference between the vanes and blades.

A number of factors contribute to risk of interference between vanes and blades. One factor affecting the axial clearance is future wear resulting from normal operating life of the gas turbine engine. The normal wear loosens the fit between the parts of the engine and allows additional axial movement therebetween. Axial movement resulting from future wear dictates a larger axial clearance than is desirable in order to compensate for any such future wear.

Another factor contributing to risk of interference between vanes and blades is the different rates of expansion of the engine case. The engine case is fabricated from metal and includes portions of varying thickness. During the transient conditions of engine operation, the different portions of the engine case heat up at different rates. The thinner portions heat and thermally expand faster than the thicker portions. The thickness of the engine case at the forward attachment point of the vane is greater than the thickness of the engine case at the rear attachment point of the vane. Therefore, while the forward attachment point expands relatively slowly during transient conditions, the rear attachment point expands relatively quickly. With expansion of the rear attachment point area, the rear portion of the vane, also known as the trailing edge, moves radially outward, while the front portion of the vane, known as the leading edge, remains substantially stationary. Such movement of the radially outer diameter portion of the trailing edge of the vane tilts the radially inner diameter portion of the vane towards the blades, thereby reducing the axial gap between the blades and vanes and threatening to cause blade damage on the radially inner portion thereof.

Currently, such axial spacing concerns are addressed by tight dimensional tolerances. Initial axial clearance tends to be larger than desired to account for different expansion rates of the engine case and to anticipate any future wear. Additional axial clearance makes sealing between static and rotating structure more difficult, adds extra weight, and has a negative impact on the aerodynamics of the gas turbine engine.

One approach to reduce risk of contact between the vanes and the blades is to increase thickness of the engine case in the thinner portions thereof, so that the rate of thermal expansion is substantially the same throughout the engine case. However, the resulting extra weight adversely affects the overall efficiency of the gas turbine engine. Furthermore, in older engines, if wear erodes the mating parts of the engine case and vanes excessively, the entire engine case must be replaced, because it is impossible to add thickness to an existing engine case. Replacement costs of the engine case are extremely high.

DISCLOSURE OF THE INVENTION

It is an object of the present invention to control axial clearance between airfoils in gas turbine engines without adversely affecting the overall efficiency of the gas turbine engine.

According to the present invention, an engine case enclosing sections of a gas turbine engine is treated selectively with a thermal barrier coating to control axial clearance between rows of airfoils by slowing the thermal expansion of that area of the engine case during transient conditions. The thermal barrier coating is applied to the thinner portions of the gas turbine engine case. The coating retards the local thermal response of the engine case to prevent axial tilting of the vane that is cantilevered from the engine case and located near the coated area.

One primary advantage of the present invention is that the axial clearance between airfoils is controlled without adding significant weight to the gas turbine engine. Another major advantage of the present invention is that the coating may be applied to new production gas turbine engines as well as to gas turbine engines already in use without affecting fits, steady state conditions, or engine performance and without having to replace any existing gas turbine engine parts.

The foregoing and other objects and advantages of the present invention become more apparent in light of the following detailed description of the exemplary embodiments thereof, as illustrated in the accompanying drawings.

BEST MODE FOR CARRYING OUT THE INVENTION

Figure 1:
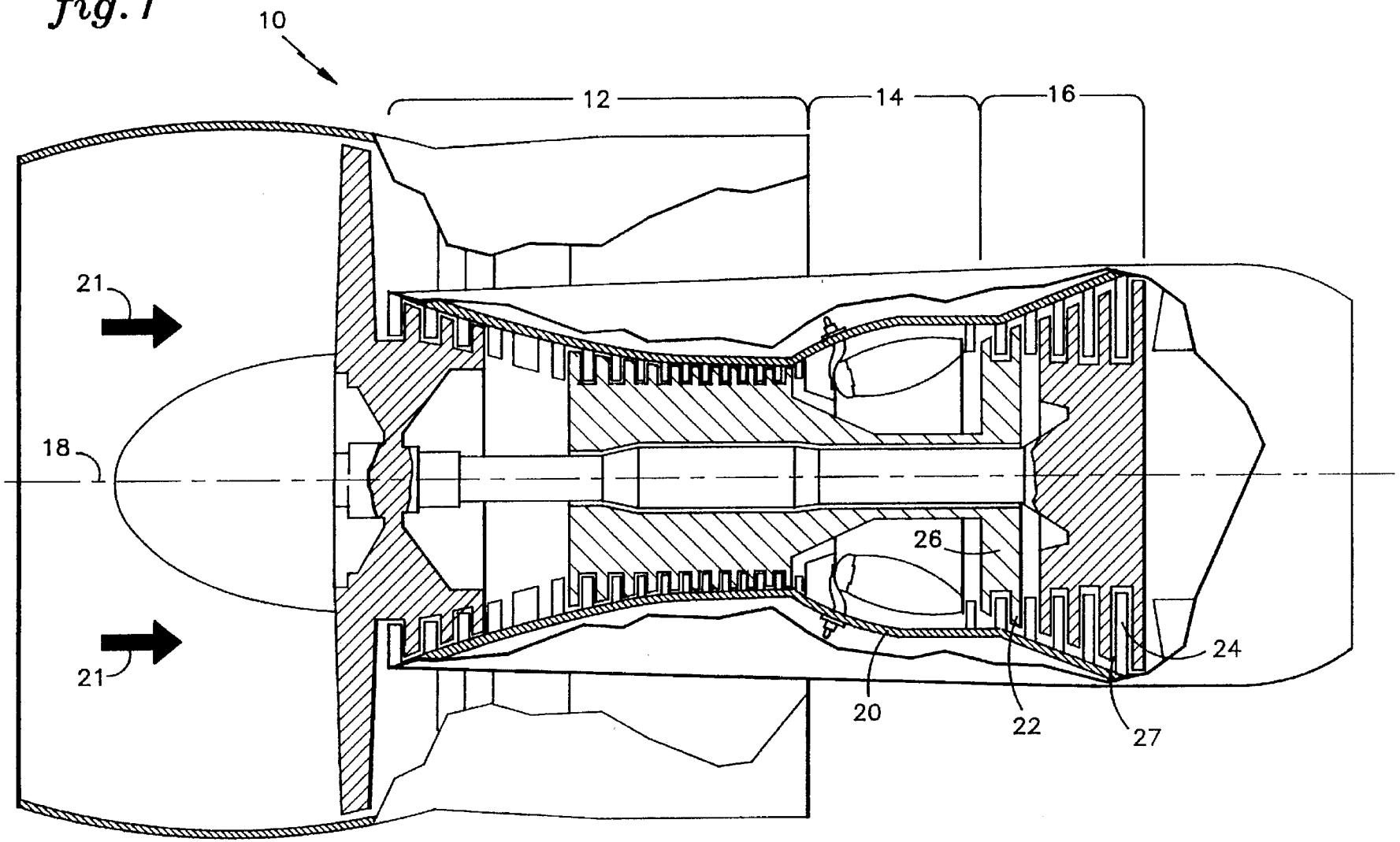
FIG. 1 is a simplified, partially broken away representation of a gas turbine engine.

Referring to FIG. 1, a gas turbine engine 10 includes a compressor 12, a combustor 14, and a turbine 16 situated about a longitudinal axis 18. A gas turbine engine case 20 encloses sections 12, 14, and 16 of the gas turbine engine 10. Air 21 flows through the sections 12, 14, and 16 of the gas turbine engine 10. The compressor 12 and the turbine 16 include alternating rows of rotating blades 22 and stationary vanes 24. The rotating blades 22 are secured on a rotating disk 26 and the stationary vanes 24 are mounted onto the engine case 20. An axial clearance 27 is defined between the blades 22 and the vanes 24.

Figure 2:
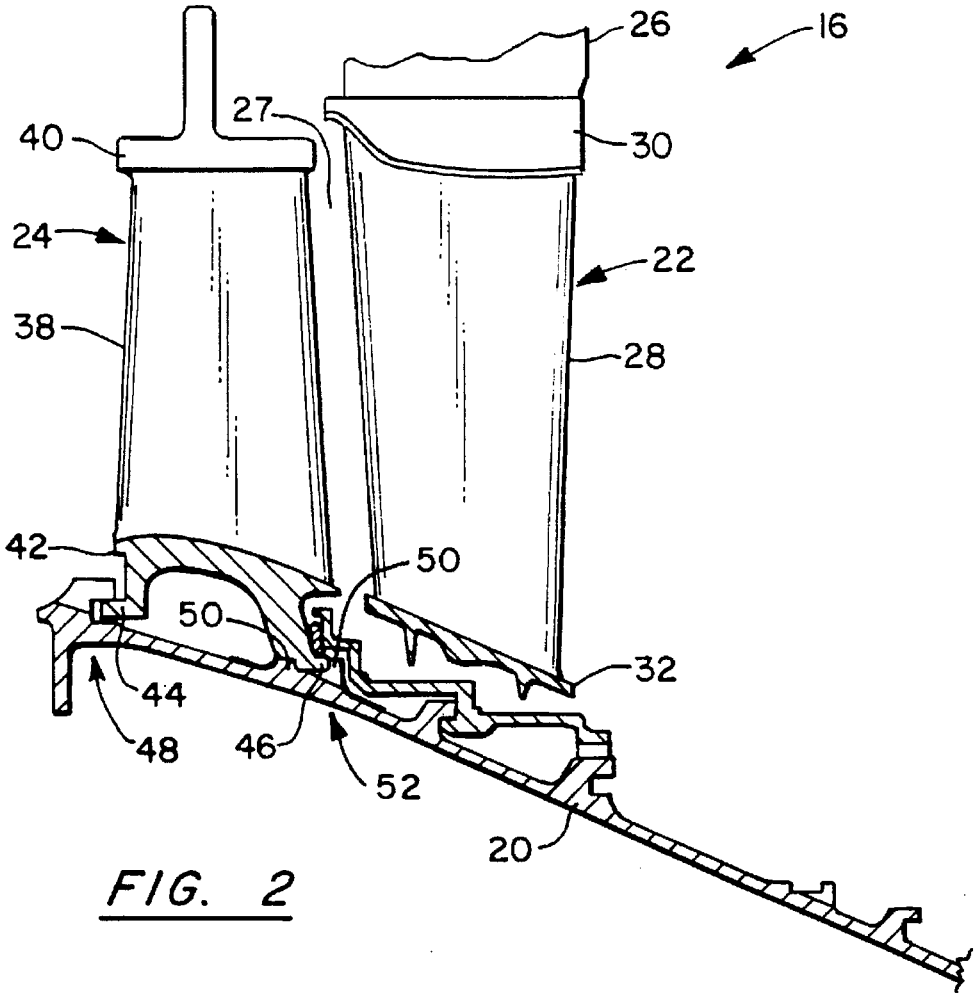
FIG. 2 is an enlarged, simplified, fragmentary representation of a blade and a vane mounted onto a gas turbine engine case of the gas turbine engine of FIG. 1.
Figure 3:
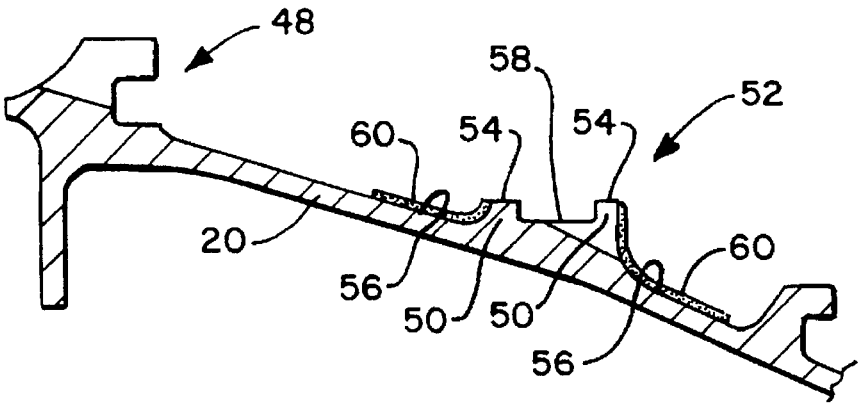
FIG. 3 is an enlarged, simplified, fragmentary representation of the gas turbine engine case of FIG. 2, selectively coated with thermal barrier coating, according to the present invention.

Referring to FIG. 2, each blade 22 includes an airfoil portion 28 flanged by an inner diameter platform 30 and an outer diameter platform 32. The inner diameter platform 30 of each blade 22 is secured onto a rotating disk 26. Each stationary vane 24 includes an airfoil portion 38 flanged by an inner diameter buttress 40 and an outer diameter buttress 42. The outer diameter buttress 42 includes a forward hook 44 and a rear hook 46. The forward hook 44 is loosely loaded into the engine case 20 at a forward attachment point 48. The rear hook 46 fits between rails 50 of the engine case 20 at a rear attachment point 52. Each rail 50 includes a top rail surface 54, an outer rail surface 56, and an inner rail surface 58, as best seen in FIG. 3.

The turbine case 20 at the forward attachment point 48 has more mass and is thicker than at the rear attachment point 52. Thermal barrier coating 60 is applied onto the outer rail surface 56, where the thickness of the engine case 20 is relatively thin. The inner rail surface 58 and the top rail surface 54 remain free of coating 60. The thickness, type, and axial width of the coating 60 depends on the specific size and needs of a particular gas turbine engine.

As the gas turbine engine 10 begins to operate, the temperature and pressure of the air 21 flowing through the compressor 12 are increased, thereby effectuating compression of the incoming airflow 21. The compressed air is mixed with fuel, ignited and burned in the combustor 14. The hot products of combustion emerging from the combustor 14 enter the turbine 16. The turbine blades 22 expand the hot air, generating thrust and extracting energy to drive the compressor 12.

The temperature of the compressed air in the compressor 12 and the temperature of the hot products of combustion in the turbine 16 are extremely high. Initially, the entire engine case 20 is cold. As the engine 10 begins to operate, the engine case 20 begins to heat up. The coating 60 retards the thermal response of the thinner portions of the engine case 20, thereby matching the thermal response of the thinner portions of the engine case coated with a thermal barrier coating with the thermal response of the thicker portions of the engine case 20. Thus, during transient conditions both, the thinner and thicker portions of the engine case 20 expand at substantially the same rate. The same rate of thermal expansion of the engine case during transient conditions ensures that the forward and the rear attachment points 48, 52 expand at approximately the same rates, thereby minimizing the pull on the rear hook 46 of the vane 24 that would otherwise result in leaning of the vane 24. For example, in JT8D gas turbine engine manufactured by Pratt & Whitney, a division of United Technologies Corporation of Hartford, Conn., the thermal barrier coating application reduces the lean on the vane 24 by at least 0.070 inches in the axial direction.

The present invention is beneficial for both new production gas turbine engines and those gas turbine engines already in use. In new gas turbine engines, the present invention allows for the reduction of an axial clearance 27 between blades 22 and vanes 24. Smaller axial clearance 27 between stationary vanes 24 and rotating blades 22 is desirable for a number of reasons. First, a smaller axial clearance 27 allows better sealing between the static and rotating structures. Second, it is better aerodynamically. Third, the overall weight of the gas turbine engine 10 can be reduced. Finally, the gas turbine engine 10 can be manufactured more compactly.

For the older engines, application of the thermal barrier coating 60 compensates for the wear due to normal operations thereof. The wear on the metal parts tends to loosen the parts and therefore increase the lean. Once the thermal barrier coating 60 is applied, the axial lean of the vanes 24 is reduced, thereby minimizing potential interference between the vanes 24 and the rotating blades 22. The present invention offers a relatively inexpensive alternative to either replacing or refurbishing an engine case already in use.

Another advantage of the present invention is that the thermal barrier coating adds almost negligible weight to the gas turbine engine, of less than one half of a pound.

Any thermal barrier coating can be used to slow the thermal response of the engine case. However, PWA 265, a two layer coating, manufactured by Pratt & Whitney, provides optimum results in JT8D engine, also manufactured by Pratt & Whitney. PWA265 coating is disclosed in a U.S. Pat. No. 4,861,618 issued to Vine et al. and assigned to Pratt & Whitney, the assignee of the present invention.

Although the invention has been shown and described with respect to exemplary embodiments thereof, it should be understood by those skilled in the art that various changes, omissions, and additions may be made thereto, without departing from the spirit and scope of the invention.

I claim:

1. A gas turbine engine including a compressor, a combustor, and a turbine, said gas turbine engine being enclosed in an engine case, said casing including a forward attachment point and a rear attachment point, said compressor and said turbine including alternating rows of stationary vanes and rotating blades, said rotating blades being secured within a rotating disk, said vanes being mounted onto said engine case by attachment at said forward and rear attachment points, said forward attachment point having more mass and being thicker than said rear attachment point, said rear attachment point having an inner rail surface for abutment with said vanes, and an outer rail surface comprising the inner surface of said casing immediately adjacent said inner rail surface, said gas turbine engine characterized by:

a thermal barrier coating being applied onto said outer rail surface and having a limited axial extent and extending fully circumferentially, said inner rail surface remaining free of coating whereby tilting of said vanes around said attachment point is minimized to maintain axial spacing between said rotating blades and said stator vanes.

* * * * *